US012709423B1

(12) United States Patent
Estabrook et al.

(10) Patent No.: US 12,709,423 B1
(45) Date of Patent: Aug. 18, 2026

(54) CONTAINER WITH AN EDGE-WRAPPING CLOSURE AND A METHOD FOR SEALING A CONTAINER USING AN EDGE-WRAPPING CLOSURE

(71) Applicant: Cambio Roasters, LLC, Isle of Palms, SC (US)

(72) Inventors: Richard Estabrook, Shelburne, VT (US); Kevin Hartley, Isle of Palms, SC (US)

(73) Assignee: Cambio Roasters, LLC, Isle of Palms, SC (US)

( * ) Notice: Subject to any disclaimer, the term of this patent is extended or adjusted under 35 U.S.C. 154(b) by 0 days.

(21) Appl. No.: 19/377,203

(22) Filed: Nov. 3, 2025

(51) Int. Cl.
*B65B 7/28* (2006.01)
*B65D 41/14* (2006.01)
*B65D 65/40* (2006.01)

(52) U.S. Cl.
CPC ..... *B65B 7/285* (2013.01); *B65B 7/2871* (2013.01); *B65B 7/2878* (2013.01); *B65D 41/14* (2013.01); *B65D 65/40* (2013.01); *B65D 2203/12* (2013.01); *B65D 2565/383* (2013.01)

(58) Field of Classification Search
CPC ..... A47J 31/00; B65D 2577/2041; B65D 77/2028; B65D 41/14; B65D 65/40; B65D 2203/12; B65D 2565/383; B65B 7/285; B65B 7/2871; B65B 7/2878
See application file for complete search history.

(56) References Cited

U.S. PATENT DOCUMENTS 1,739,581 A * 12/1929 Ellis ..... B65D 41/14 106/230
2,356,825 A * 8/1944 Copeman ..... B65D 51/00 215/326
2,361,507 A * 10/1944 Sonnenberg ..... B65D 41/145 215/292
3,590,554 A * 7/1971 Carter ..... B65B 7/2878 53/329.2
3,660,965 A * 5/1972 Morera ..... B65B 7/2878 53/329.3
4,184,310 A * 1/1980 Shelby ..... B29C 66/73715 426/123
5,249,410 A * 10/1993 Bakker ..... B29C 66/849 53/329.3
6,291,037 B1 * 9/2001 Bakker ..... B29C 65/66 53/442
8,245,873 B2 * 8/2012 Steg ..... B65D 77/208 229/5.5
8,905,251 B2 * 12/2014 Kornfeld ..... B65D 77/2056 220/359.4
9,630,752 B2 * 4/2017 Kooney ..... B65D 41/165
2014/0166682 A1 * 6/2014 Huffer ..... B29C 66/53461 220/780
2025/0282517 A1 * 9/2025 Bodenstein ..... B65D 3/18

* cited by examiner

*Primary Examiner* — Kareen K Thomas
(74) *Attorney, Agent, or Firm* — Caldwell LLC

(57) ABSTRACT

A method for sealing a container using an edge-wrapping closure, wherein the method further includes providing a container body including: an open end having a rim defined by a bead extending outwardly from a body wall; a cavity; and a closed end; receiving a lid; aligning and placing the lid flush against the rim of the open end of the container body; and sealing the lid over the rim of the open end of the container body by folding the lid over and around the bead of the rim wherein the lid extends along an outer surface of the bead.

20 Claims, 7 Drawing Sheets

CONTAINER WITH AN EDGE-WRAPPING CLOSURE AND A METHOD FOR SEALING A CONTAINER USING AN EDGE-WRAPPING CLOSURE

FIELD OF THE INVENTION

The present invention generally relates to the field of packaging. In particular, the present invention is directed to a method for sealing a container using an edge-wrapping closure.

BACKGROUND

Small containers commonly include a body with an open end closed by a lid sealed across a rim. In conventional designs, the lid is typically affixed flat against the rim surface. While this approach provides closure, such seals may be prone to leakage, peeling, or reduced integrity when the container is handled, transported, or exposed to pressure changes. Improvements are needed in sealing technologies that enhance lid retention and reliability.

SUMMARY OF THE DISCLOSURE

In an aspect, a method for sealing a container using an edge-wrapping closure is described. The method includes providing a container body including: an open end having a rim defined by a bead extending outwardly from a body wall; a cavity; and a closed end; receiving a lid; aligning and placing the lid flush against the rim of the open end of the container body; and sealing the lid over the rim of the open end of the container body by folding the lid over and around the bead of the rim wherein the lid extends along an outer surface of the bead.

In another aspect, a container body with an edge-wrapping disclosure is described. The container body includes: a container body including: an open end having a rim defined by a bead extending outwardly from a body wall; a cavity; and a closed end; a lid aligned and placed flush against the rim of the open end of the container body, wherein the lid is folded over and around the bead of the rim wherein the lid extends along an outer surface of the bead.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

At a high level, aspects of the present disclosure are directed to container with an edge-wrapping closure and a method for sealing a container using an edge-wrapping closure. In an embodiment, a method for sealing a container using an edge-wrapping closure having a providing a container body comprising an open end having a rim defined by a bead extending outwardly from a body wall, a cavity, and a closed end; receiving a lid; aligning and placing the lid flush against the rim of the open end of the container body; and sealing the lid over the rim of the open end of the container body by folding the lid over and around the bead of the rim wherein the lid extends along an outer surface of the bead.

Aspects of the present disclosure can be used to produce a lid that securely encloses a container body. Aspects of the present disclosure allow for secure sealing of a lid around a container. Exemplary embodiments illustrating aspects of the present disclosure are described below in the context of several specific examples.

Figure 1:
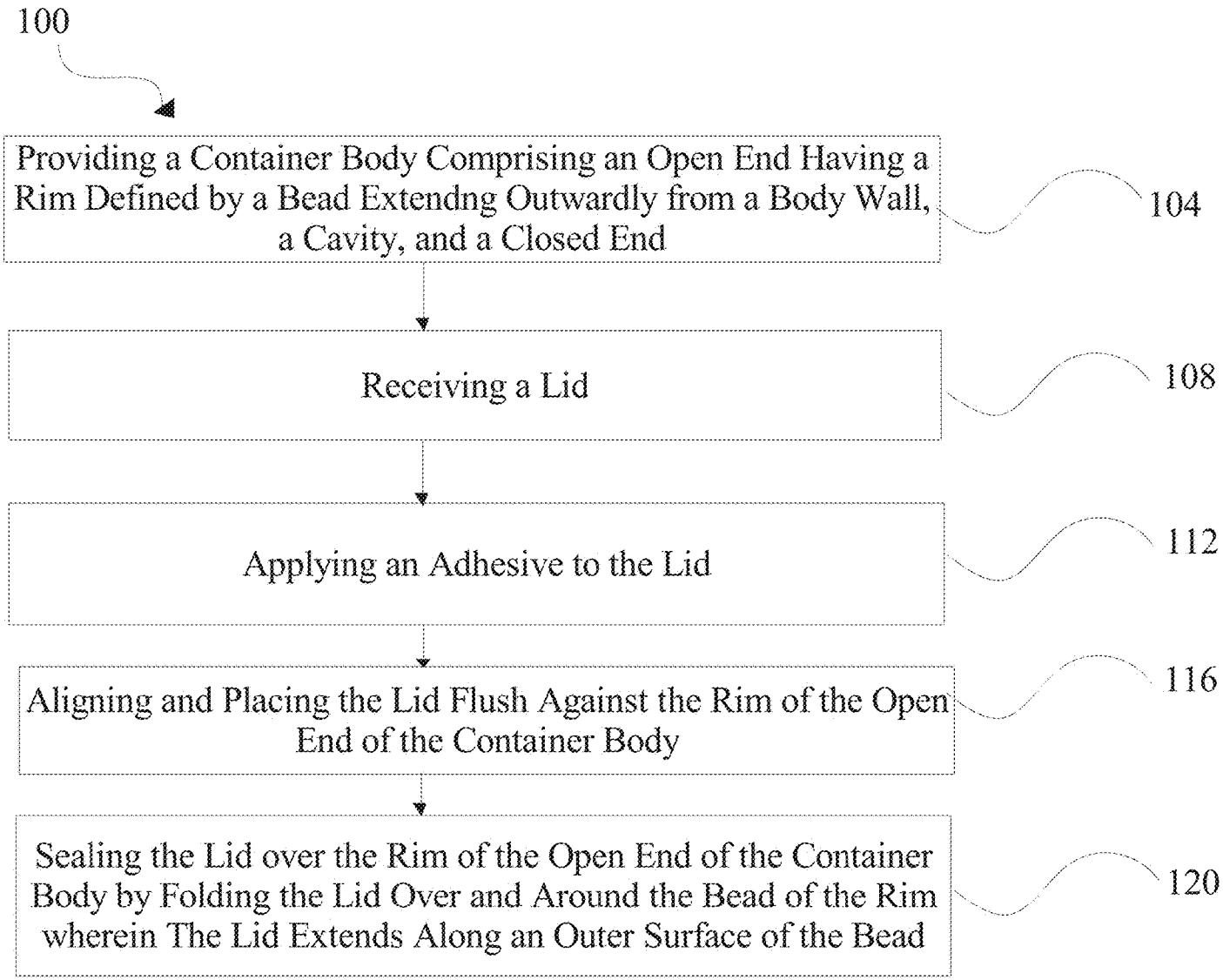
FIG. 1 is a flow diagram illustrating a method for sealing a container using an edge-wrapping closure.

Referring now to FIG. 1, an exemplary embodiment of a method for sealing a container using an edge-wrapping closure. In an embodiment, the method may include step 104 providing a container body having an open end including a rim with a bead, a body wall, a cavity, and a closed end, receiving a lid aligning and placing the lid flush against the rim of the container body, and sealing the lid to the container body, wherein sealing includes folding the lid material over and around the bead of the rim such that the lid extends along an outer surface of the bead. Once complete, the sealed container may be removed to a secondary packaging process. As used in this disclosure, a "secondary packaging process" is a packaging process outside of the process being described. For example, and without limitation, a secondary packaging process may include any packaging process following the process as being described. This may include packaging processes for interior aspects of a product and/or exterior packaging of a product. In an embodiment, the method may additionally include singulation of one or more container bodies prior to receipt of a container body. The method may further include the production or formation of lids. In an embodiment where the method includes the formation of lids, formation may include receiving a lid material, shaping the lid material, and removing the shaped lid material to a secondary packaging process. An embodiment that includes lid formation may additionally include additional steps related to labeling, such as stickering, printing, and/or stamping of the lid material. Alternatively, in an embodiment where lid formation has occurred separately, additional steps related to labeling may still be undergone. As used in this disclosure, "stickering" is the process of placing a sticker on the surface of an item. Further, some embodiments of the method may include de-nesting of one or more lids prior to the receipt of a lid. The method produces a container with a lid sealed over and around the rim bead to enclose the bead between the lid and the container body, thereby increasing seal integrity and reducing the likelihood of peeling or leakage. This may be implemented, without limitation, as disclosed in U.S. application Ser. No. 18/599,862, filed on Mar. 8, 2024 and entitled "HIGHLY RECYCLABLE BEVERAGE PODS AND METHOD OF MANUFACTURE" the entirety of which is incorporated herein by reference.

With further reference to FIG. 1, the method includes step 108 including providing a container body with a lid configured to wrap over and around a rim bead of the container body. A container body with such a lid may include a body wall, a cavity, a closed end, and an open end having a rim defined by a bead extending outwardly from the body wall. In some cases, the rim of the container body may vary in size or profile depending on the intended contents of the container. For example, and without limitation, a container body configured to hold a heavier or pressurized material may include a more pronounced bead as compared to a container body intended for lighter contents. The bead may form a lip or ridge that provides a mechanical engagement point for the lid. As used in this disclosure, a "lip" refers to the projecting edge of the container opening, while a "ridge" refers to a surface extending outwardly from the body wall. The lid is configured to be sealed flush against the opening of the container body and folded over the bead such that the bead is at least partially enclosed between the lid material and the body wall. This arrangement enhances seal integrity and reduces the likelihood of peeling or leakage during handling, transport, or exposure to internal pressure. In some embodiments, the rim may also include a polymer lining, adhesive, or coating to further assist in the sealing process. The body wall of the container body may be curved, cylindrical, cube-like, prism-like, or otherwise shaped, with the dimensions of the lid necessarily configured to correspond to the dimensions of the container opening. Furthermore, the body wall or rim of the container body may include detents, rivets, beads, or other fastening features configured to engage with or reinforce the sealed lid. The container body may be formed of glass, plastic, metal, metal alloys, or combinations thereof. In some embodiments, the wrapping seal may include a pull tab or unbonded portion of the lid configured to facilitate removal.

Continuing to reference FIG. 1, in some embodiments, a lid sealed to the rim of the open end of the container body may include a lid made of flexible packaging material configured to fold over and around the rim bead of the container. Flexible packaging material may include, without limitation, polymers, metals such as aluminum, paper, laminates, and/or recycled materials. The size and shape of the lid may correspond to the size and geometry of the container body, such that a circular container body may employ a circular lid, while other container shapes may employ lids of matching shape. In certain embodiments, the lid may include multiple layers of material, for example, co-extruded or laminated polymer layers that provide printability, sealing capability, and barrier protection. Because the lid material is folded over the rim bead and extends along an outer surface of the bead, at least a portion of the material may be configured for flexibility and stretchability to conform to the bead profile without tearing. In some embodiments, the lid may further include an adhesive layer or polymer coating specifically positioned along the fold line to reinforce the wrapped seal. Method 100 may include step 112 representing applying an adhesive to the lid. In some embodiments, the adhesives may include pressure-sensitive adhesives such as acrylic-based, rubber-based, or silicone-based formulations; heat-activated adhesives including ethylene-vinyl acetate (EVA), polyamide, or polyurethane reactive (PUR) hot melts; and solvent- or water-based adhesives such as polyvinyl acetate (PVA) emulsions, acrylic emulsions, or natural latex adhesives. In additional embodiments, structural or specialty adhesives may be used, including epoxy resins, phenolic resins, or melamine-based adhesives for high-strength bonding applications. Other suitable adhesives may include ultraviolet (UV)-curable adhesives, moisture-curable urethanes, cyanoacrylates, and anaerobic adhesives, which provide rapid curing and high durability. Still further embodiments may employ sealant-type adhesives such as polyisobutylene, butyl rubber, silicone elastomers, or polysulfide formulations, which can provide enhanced resistance to moisture, gas, or chemical exposure. The selection of adhesive may be based on factors such as compatibility with the lid and container materials, desired sealing strength, flexibility, curing profile, and compliance with regulatory requirements for intended use environments. This configuration provides both a primary seal across the container opening and a secondary seal along the outer surface of the bead, thereby increasing overall seal integrity and resistance to leakage or delamination.

Further referencing FIG. 1, in some embodiments, a pull tab may be configured as part of the fold-over lid. The pull tab may extend from the periphery of the lid material, positioned beyond the wrapped edge, such that a user can grasp and peel the lid by lifting the folded-over portion away from the bead. Alternatively, the pull tab may be integrated into the folded portion of the lid, for example, by leaving an unsealed section along the bead that can be peeled back to initiate removal. In an embodiment where the pull tab is formed separately, it may be attached to the lid with an adhesive, a polymer bond, or mechanical joining methods. The pull tab may include reinforcing components such as plastic films, paper layers, metallic threads, or other strengthening materials to prevent tearing during removal. In some embodiments, the fold-over configuration may allow the pull tab to be recessed against the sidewall of the container when not in use, reducing the likelihood of accidental snagging during transport or storage. In other embodiments, the pull tab may be defined by a perforation or weakened line along the folded edge of the lid, such that application of force transforms the folded material into a tab. The pull tab may also be printed, stamped, or otherwise marked with indicia to guide the user in opening the sealed container.

With continued reference to FIG. 1, in an embodiment where the pull tab is formed separately, the pull tab may be attached to the lid using a variety of joining techniques, each selected according to material compatibility and intended performance. For example, the pull tab may be secured by an adhesive layer, such as a pressure-sensitive adhesive, a hot-melt adhesive, or a heat-activated adhesive coating. Pressure-sensitive adhesives may allow the tab to be pressed into position during manufacture and immediately adhere without requiring additional energy input, while hot-melt or heat-activated adhesives may flow into surface irregularities of the lid material and cure to form a permanent bond. Alternatively, the pull tab may be joined to the lid by polymer bonding methods, such as ultrasonic welding, thermal welding, induction sealing, or solvent bonding. In ultrasonic welding, localized high-frequency vibrations may fuse the polymeric surfaces of the tab and lid without introducing additional adhesives. In thermal or induction welding, heat may be applied to melt an interface layer, bonding the tab directly to the lid's polymer surface. Solvent bonding may also be employed where the lid and pull tab are formed of solvent-soluble polymers, allowing partial dissolution and re-solidification at the interface to form a unitary bond. In another embodiments, the pull tab may be connected by mechanical joining methods. For example, the tab may be inserted into a slit, aperture, or perforation formed in the lid margin, where it can be locked in place by folding, crimping, or interlocking features. The pull tab may also be riveted, stapled, or crimped into the lid using a small mechanical fastener, or may be woven or stitched into a fibrous lid material such as a laminated paper-polymer composite. In some embodiments, the separately formed pull tab may include reinforcement structures to increase strength and durability at the bond site. Reinforcements may include a widened base portion of the tab, a backing strip laminated to the lid, or the use of a multi-layer pull tab in which at least one layer extends into the bonded interface to prevent delamination. The bonded region may be coextensive with or larger than the functional gripping region of the tab, thereby distributing stresses over a larger surface area and reducing the likelihood of tearing at the bond site.

Continuing to reference FIG. 1, in some embodiments, lid may be made of flexible packaging material configured to fold over and around the rim bead of the container. Flexible packaging material may include, without limitation, polymers, metals such as aluminum, paper, laminates, and/or recycled materials. The size and shape of the lid may correspond to the size and geometry of the container body, such that a circular container body may employ a circular lid, while other container shapes may employ lids of matching geometry. In certain embodiments, the lid may include multiple layers of material, for example, co-extruded or laminated polymer layers that provide printability, sealing capability, barrier protection, and mechanical flexibility. Because the lid material is folded over the rim bead and extends downward along an outer surface of the bead, the lid must be sufficiently compliant to stretch and conform to the bead geometry without tearing, delaminating, or creating stress concentrations. The fold-over geometry may involve a curvature of the lid material that transitions from a horizontal plane across the container opening into a vertical or angled plane along the bead. This transition zone may be engineered with thinner cross-sections, elastic polymers, or pre-creased folds to aid in conforming tightly to the bead. In some embodiments, the fold line may incorporate heat-activated or pressure-sensitive adhesives that lock the lid against the bead once folded. The adhesives may be selectively applied along the curved transition zone of the lid so that adhesion occurs both on the horizontal sealing surface at the top of the rim and on the vertical or angled surface of the bead. This arrangement creates a dual-surface engagement: a primary seal spanning across the opening of the container body and a secondary seal that grips and conforms to the bead along its outer perimeter. The use of dual adhesion zones allows the lid to anchor in two orthogonal planes, thereby distributing mechanical stresses encountered during pressurization, thermal cycling, or physical handling. For example, when the container is subjected to internal vapor or liquid pressure, the primary horizontal seal prevents upward displacement, while the secondary vertical seal resists outward peeling forces at the rim edge. This cooperative sealing geometry substantially reduces risks of leakage, peeling, or lid lift compared to flat-sealed lids that rely solely on a single planar bond. In certain embodiments, the adhesive may be formulated to flow slightly during heat activation, enabling it to penetrate micro-grooves or surface irregularities of the bead and thereby improve mechanical interlock. Pressure-sensitive adhesives may likewise be formulated with elastomeric components that maintain contact under flexing or deformation of the bead. In yet other embodiments, a combination of adhesive types may be used, such as a heat-activated adhesive for the horizontal sealing plane and a pressure-sensitive adhesive for the vertical bead engagement, to optimize bond performance across both regions. This dual-engagement sealing system enhances overall sealing integrity, improves resistance to elevated pressures or vacuum conditions, and increases shelf stability of the sealed container. Moreover, the fold-over adhesive configuration provides greater tamper resistance, as the lid must be detached from both the horizontal and vertical sealing planes before removal, thereby reducing the likelihood of accidental or premature lid detachment during storage, shipping, or consumer use.

Further referencing FIG. 1, in some embodiments, a pull tab may be configured as part of the fold-over lid and may be influenced by the fold-over geometry. The pull tab May extend from the periphery of the lid material, positioned beyond the folded edge, such that a user can grasp and peel the lid by lifting the wrapped portion away from the bead. In this arrangement, the fold-over geometry allows the pull tab to act as a lever point, giving the user mechanical advantage to break the adhesive or bonded interface along the fold. Alternatively, the pull tab may be integrated within the folded portion itself, for example, by leaving an unsealed section of the lid along the bead so that the user can insert a finger or tool beneath the fold to initiate peeling. In an embodiment where the pull tab is formed separately, it may be attached to the folded edge of the lid using adhesives, polymer bonds, or mechanical fasteners. To ensure strength during opening, the pull tab may include reinforcement such as plastic films, metallic foils, woven threads, or laminated paper layers. The fold-over geometry also enables additional pull-tab variations. For example, the pull tab may be recessed along the sidewall of the container when the lid is folded, preventing snagging or accidental opening during packaging or shipment. In other embodiments, the fold-over edge of the lid may be perforated or scored such that the action of pulling creates a controlled tear line, effectively transforming part of the folded rim into a pull tab. The pull tab, whether integrated or separate, may also carry printing, embossing, or markings that visually indicate its location and provide user instructions.

Further referencing FIG. 1, method 100 may include step 104 including providing a container body, wherein the container body may include an open end having a rim defined by a bead, a body wall, a cavity, and a closed end. In some embodiments, the rim bead of the container body may be between 45-55 mm in diameter, although other dimensions are contemplated depending on container size. The bead may project outwardly from the container wall to form a lip or ridge, thereby providing a surface against which the lid can be both sealed and folded. Unlike recessed-rim configurations where the lid is seated within the container, the bead provides a structural feature for the lid to wrap over and around, such that the lid material extends from the top surface of the rim down along the outer surface of the bead. In some embodiments, the rim bead may further include an adhesive and/or polymer layer to aid in the sealing process. Such coatings may be formulated with polymers, adhesives, or co-extruded films, including but not limited to pullulan, hydroxypropyl methylcellulose, polyvinyl alcohol, polyethylene glycol, xanthan gum, guar gum, gum arabic, polyacrylates, starch derivatives, collagen, gelatin, zein, gluten, soy protein isolate, whey protein isolate, casein, polysaccharides, natural gums, and/or mixtures thereof. In some embodiments, co-extrusion processes may be applied to produce films with desired properties such as humidity barriers or flexibility. For example, co-extruded polypropylene may be used, providing good optical qualities and a strong moisture barrier. Adhesives may include water-based glues, resin formulations, starch glues, or dextrins. The fold-over geometry may affect how such coatings are applied. For example, an adhesive may be selectively placed at the fold line of the lid material so that adhesion occurs along both the top sealing surface and the vertical bead surface, creating a dual-surface engagement. This dual sealing system improves resistance to internal pressure, prevents lid peeling, and enhances durability during handling and transport. The container body itself may be formed of plastic, metal, metal alloys, recycled materials, glass, or combinations thereof, while the cavity may be circular, cylindrical, polygonal, or cup-like in cross-section. In some embodiments, the cavity may have a singular opening, while the closed end may include indentations or reinforcing structures to assist in later product use.

With further reference to FIG. 1, providing a container body may include incorporating a body formed in another manufacturing method, including those involving polymer linings or adhesive coatings on the rim bead. In some embodiments, the container body may be pre-filled with a product prior to sealing with the fold-over lid. Nonlimiting examples of such products include foodstuffs, beverages, or other consumable or non-consumable materials requiring a sealed container. Furthermore, method 100 may include singulation of one or more container bodies. Singulation refers to the process of separating container bodies from a nested group and aligning them for further processing. In the context of the fold-over sealing method, singulation and justification may be particularly important to ensure that the bead of each container is properly aligned with the lid placement system, thereby ensuring that the lid material folds uniformly over the bead. For example, when adhesive zones are applied to both the horizontal sealing plane and the bead's outer surface, precise positioning of the container body relative to the sealing head ensures that the fold occurs consistently along the rim circumference. In some embodiments, the justification step may also account for lid features such as pull tabs or perforated regions by aligning these features with designated areas of the bead or container wall. In some embodiments, singulation may occur directly after a de-nesting process, wherein individual container bodies drop into a receptacle or conveyor configured to hold the bodies during the sealing operation. Proper justification may include aligning the bead profile, adhesive layer, or fold-over geometry with the sealing and folding mechanism, thereby producing a uniform wrapped seal around the rim bead.

Continuing to reference FIG. 1, method 100 may include step 108 of receiving a lid. A lid may be received from a prior lid formation process as described below and/or from a preformed lid supply. As used in this disclosure, "pre-formed" refers to lids being pre-shaped and prepared in a separate process prior to receipt. In either embodiment, de-nesting of one or more lids may be necessary. De-nesting refers to the process of removing individual lids from a stacked arrangement of multiple lids. In some embodiments, the lids may be shaped with a peripheral margin designed to accommodate the fold-over geometry, which can influence stacking density and de-nesting mechanics. For example, a lid intended to wrap over a rim bead may include a slightly larger diameter or an outwardly projecting flange that requires careful handling to avoid bending prior to sealing. De-nesting may occur manually or by using automated de-nesting machines. Such machines may employ peel de-nesters, pick-and-slide mechanisms, pick-and-place devices, robotic arms, or vacuum picking systems. Vacuum picking systems, in particular, may be advantageous for fold-over lids, as they can lift lids from the center or reinforced regions without distorting the foldable margin. This ensures that the foldable portion of the lid remains intact and properly aligned for the subsequent sealing step.

Method 100 may further include the formation of a lid, wherein formation includes receiving lid material, shaping the lid material, and preparing the shaped lid for transfer to a secondary packaging process. Lid material may include foils, polymers, laminates, or composite films such as paper-laminated aluminum, aluminum foil material with a heat-activated lacquer coating, or multi-layer plastics. In some embodiments, lids configured for fold-over sealing may be designed with enhanced flexibility at the edge region, such as a thinner laminate or a pre-scored fold line, to facilitate reliable wrapping around the rim bead during sealing. Shaping the lid material may occur through roll stock lidding and/or die-cut lidding processes. Roll stock lidding may be produced in continuous web form, printed and slit into smaller rolls, and then used directly on packaging machinery. Alternatively, die-cutting may be employed to produce uniform lids in precise shapes and dimensions, particularly important where the fold-over geometry requires consistent edge margins to ensure proper wrapping and adhesion around the rim bead. In some embodiments, adhesives or polymer coatings may be selectively applied to the lid material prior to shaping. For example, adhesive rings may be applied to both the central sealing region and the peripheral edge region intended to fold over the bead. This arrangement minimizes waste and ensures adhesion only where required to achieve the dual-surface seal. The lid may further undergo printing, stamping, or labeling, such as the addition of branding, product information, or tamper-evidence markings. In another embodiment, stickers may be placed on the lid surface to provide labeling. These processes may occur before or after lid shaping and may be carried out manually or by automated manufacturing systems.

Further referencing FIG. 1, method 100 may include step 116 aligning and placing the lid flush against the rim of the open end of the container body. As used in this disclosure, "flush" refers to the lid being positioned in direct contact with the top sealing surface of the rim while extending outwardly beyond the rim bead to enable a subsequent fold-over operation. In some embodiments, this placement step may occur as a continuation of the de-nesting process, while in other embodiments the placement may be accomplished manually or by automated equipment. In some embodiments, precise placement may be accomplished by a pick-and-place system configured to hold the lid in a manner that avoids deformation of the peripheral edge designed to wrap around the bead. Placement accuracy ensures that the central region of the lid covers the container opening, while the peripheral margin is evenly distributed around the bead circumference, providing material for folding. This uniform overhang is critical to achieving a continuous wrapped seal that encloses the bead. Indexing systems such as rotary or linear intermittent-motion mechanisms may be employed to position each container body beneath the placement device. Once indexed, the lid is applied flush across the rim, with adhesives or polymer coatings pre-oriented so that when the peripheral edge is folded downward, the coated regions align with both the top horizontal surface and the vertical outer surface of the bead. The bead itself may function as an alignment guide, ensuring that the lid edge is seated consistently prior to folding. Accordingly, the alignment and placement process not only ensures sealing engagement across the container opening but also establishes the precise overhanging margin required to execute the fold-over geometry, which distinguishes the present method from conventional lids sealed solely in a single horizontal plane.

With continued reference to FIG. 1, method 100 may include step 120 of sealing the lid to the container body by folding the lid over and around the bead of the rim such that the lid extends along an outer surface of the bead. Sealing may begin with the lid positioned flush across the open end of the container body, with a peripheral margin of the lid material extending beyond the rim bead. During sealing, heat, pressure, and/or adhesive activation may be applied to conform the lid material around the bead, thereby creating a continuous seal across both the top surface of the rim and the vertical or angled surface of the bead. In some embodiments, sealing includes applying heat to the lid material at the fold line such that the material becomes pliable and capable of conforming tightly to the bead profile. Pressure may then be applied circumferentially to the overhanging portion of the lid, folding it downward and pressing it against the bead's outer surface. This folding motion may be performed by a sealing head, roller, or forming tool designed to apply uniform force around the entire circumference of the rim. Once folded, the lid material may be cooled or cured in place, locking the lid into a wrapped configuration that encloses the bead between the lid and the body wall. In some embodiments, the lid comprises an aluminum foil material and polymeric coatings. In some embodiments, adhesives or polymeric coatings may be selectively applied to the lid or rim bead to assist in bonding. For example, a first adhesive region may secure the lid to the top sealing surface of the rim, while a second adhesive region may secure the folded portion of the lid to the outer surface of the bead. This dual-surface engagement produces a seal that is both hermetic and mechanically reinforced, resisting peeling, leakage, or lid lift during shipping, storage, or consumer use. In certain embodiments, heat-activated adhesives may flow slightly during sealing, filling surface irregularities of the bead to further improve bond strength. Pressure-sensitive adhesives may likewise be used to maintain adhesion under repeated flexing or handling of the container. The fold-over seal not only prevents air or liquid exchange between the cavity and the external atmosphere but also mechanically grips the bead, functioning as a locking feature. This configuration may eliminate common failure modes of conventional flat-sealed lids, such as delamination at the rim edge or premature peeling under internal pressure. The lid material may be metallic foil, polymeric film, laminate, paper-based material, or combinations thereof, with the fold-over geometry permitting both rigid and flexible materials to be used depending on the application. In some embodiments, the sealing process may be performed using induction sealing, convection heat sealing, ultrasonic welding, or mechanical crimping in combination with adhesives. For example, convection heat sealing may be performed at temperatures between 240° C. and 350° C., with dwell times between 0.4 and 2.0 seconds, and with applied pressures sufficient to conform the lid material tightly around the bead. In this approach, the applied heat softens the lid material so that pressure can deform and mold it against the contours of the bead, creating a uniform and airtight seal. Ultrasonic welding may be applied locally at the fold line to fuse polymeric layers along the bead. In this approach, high-frequency vibrations generate localized frictional heat, causing the polymeric layers to melt and bond without the need for bulk heating of the entire lid or container. Ultrasonic welding may be applied locally at the fold line to fuse polymeric layers along the bead. In this method, the lid may be held in position while ultrasonic vibrations focus energy directly at the fold interface, producing localized melting and solidification to lock the lid around the bead. In other embodiments, adhesive-only sealing may be employed, wherein the fold-over action is mechanically maintained by adhesive curing without the need for significant heat or ultrasonic energy. The adhesive may penetrate micro-gaps between the lid and bead surface, and once cured, the adhesive layer acts as both a bonding agent and a barrier to prevent lid separation under handling or transport. This sealing configuration may also include optional pull tabs integrated into or extending from the folded edge. In such embodiments, a portion of the folded material may be left unsealed, providing a user with a grip point to peel the lid away from the bead. Peeling may require overcoming adhesion along both the top and bead surfaces, thereby ensuring tamper resistance until intentional opening. Accordingly, the fold-over sealing method creates a hermetic and mechanically reinforced closure that is enabled by the combination of flush placement, controlled overhang, heat and/or adhesive activation, and circumferential folding of the lid material over and around the bead. This dual-plane seal provides enhanced performance under pressure, improved shelf stability, and increased tamper resistance, distinguishing the invention from conventional flat-sealed containers.

With continued reference to FIG. 1, sealing the lid over the rim of the open end of the container body by folding the lid over and around the bead of the rim, wherein the lid extends along an outer surface of the bead, may produce a multi-vector restraint system. The horizontal bond across the opening resists upward displacement, while the vertical bond along the bead resists lateral peeling and shear forces. This dual-plane adhesion distributes stresses more evenly across the lid material and rim, preventing localized delamination and reducing the risk of premature failure. The bead effectively functions as an anchoring geometry, with the folded lid acting as a clamping band that mechanically locks the lid in place. The continuous circumferential fold also increases the effective bonding surface area compared to traditional flat seals, enhancing seal strength without requiring thicker or more adhesive-rich lid materials. In some embodiments, the structural rigidity imparted by the folded margin may create a hoop-stress effect around the rim, further reinforcing the seal under internal pressure conditions such as carbonation, heating, or vacuum. By integrating the bead into the sealing mechanism, the lid becomes both a barrier and a mechanical fastener, resulting in a closure that is stronger, more stable, and less susceptible to environmental or handling stresses than conventional designs.

With further reference to FIG. 1, method 100 may include removing the sealed container body and fold-over lid to a secondary packaging process. Secondary packaging may include sleeves, cartons, boxes, trays, or other containment structures configured to hold one or more sealed container bodies. In some embodiments, secondary packaging may include cutouts or partitions dimensioned to accommodate the bead-wrapped profile of the sealed container, thereby securing the containers in place during storage and transport. Partitioned sliders, molded trays, or other dividers may be used to maintain spacing between adjacent containers, preventing damage to the folded lid edges. Secondary packaging may further include protective coverings such as shrink wrap, films, or laminates configured to prevent tampering or contamination. The exterior of the secondary packaging may include surfaces displaying printed images, product information, branding, or other indicia. In some embodiments, the packaging may be designed to highlight the unique structural features of the bead-wrapped closure, such as by using transparent cutouts or printed illustrations to demonstrate the reinforced lid seal. The secondary packaging process may also include additional singulation and precision positioning steps to ensure that each sealed container body is properly oriented within its packaging. These steps may be performed manually or by automated machinery. Once completed, secondary packaging units may be grouped into larger cases or boxes for bulk distribution, thereby increasing shipping efficiency and reducing handling risks. The transition to secondary packaging represents the final step of the manufacturing method, whereby the sealed container bodies with fold-over lids are prepared for storage, transit, and eventual consumer use.

With continued reference to FIG. 1, manufacturing and/or forming of the container body and lid may be performed, without limitation, using a manufacturing device. A manufacturing device may include forming tools, sealing heads, thermal elements, ultrasonic welders, adhesive applicators, folding dies, crimping tools, or any combination thereof configured to produce a container with a lid sealed by folding the lid material over and around a bead of the rim. In some embodiments, the manufacturing device may incrementally form the container body through processes such as injection molding, thermoforming, or stamping, while separately forming lids through roll stock cutting or die-cutting operations. The lid material may then be transferred to a sealing station where it is aligned, placed flush across the rim opening, and folded over the bead to extend along the bead's outer surface. In certain embodiments, the manufacturing device may include a heating or curing system configured to activate adhesives or soften the lid material at the fold line so that it conforms tightly to the bead profile. Heating may be accomplished by convection, induction, radiant, or ultrasonic energy, while pressure may be applied through rollers, clamps, or forming jaws that progressively bend the lid margin downward around the bead. This folding step may occur incrementally in multiple stages or continuously in a single circumferential motion. The manufacturing device may further include robotic handling systems, including robotic arms, conveyors, pick-and-place devices, and rotary indexing tables configured to transport container bodies and lids through the manufacturing process. Such systems may maintain precise orientation between the lid and the bead so that the fold-over geometry is consistently applied along the entire circumference. In some embodiments, sensors and feedback systems may monitor lid alignment, bead conformity, or adhesive activation, with controllers adjusting process parameters such as pressure, temperature, and dwell time in real-time.

In other embodiments, subtractive and/or mechanical operations may be applied as part of the fold-over sealing process. For example, trimming operations may remove excess lid material after folding to create a smooth edge profile, while embossing or stamping operations may impart patterns that lock the folded lid more securely against the bead. Milling, laser scoring, or die-cutting may be used to create pull tabs or perforations within the folded region. The manufacturing device may include powered or automated systems capable of carrying out each step with precision and repeatability. Powered systems may drive the movement of sealing heads, rollers, folding dies, or indexing tables, while automated controllers may sequence operations and apply feedback corrections. Controllers may include programmable logic controllers (PLC), microcontrollers, or computer-based systems configured to store process recipes for different lid and container body sizes. Such controllers may regulate time, temperature, pressure, adhesive dispensing, and folding mechanics to ensure that the fold-over seal is consistent across high-volume production runs. An automated manufacturing system for the present invention may therefore be configured not only to produce sealed containers but also to enable variations of the fold-over geometry. For instance, the system may fold the lid fully down the bead to cover the rim entirely, partially fold the lid for hybrid seals, or produce recessed folds where the bead geometry is modified. Multiple sealing technologies may be integrated, including heat sealing, ultrasonic welding, adhesive sealing, or combinations thereof, to ensure both hermetic closure and mechanical reinforcement.

With continued reference to FIG. 1, following sealing, further processing may occur, such as polishing or trimming the folded edge, applying coatings for improved barrier performance, or adding printing, branding, and labeling to the lid or folded portion. The fold-over design may be finished with optional tamper-evident features, such as perforations that tear upon opening, or texturing that improves grip at the folded edge. Fundamentally, the manufacturing device may include any combination of mechanical, thermal, adhesive, or automated components configured to reliably produce containers sealed by folding the lid material over and around the bead of the rim, wherein the lid extends along an outer surface of the bead.

Continuing to reference FIG. 1, method 100 may include a computing device. Computing device includes a processor communicatively connected to a memory. As used in this disclosure, "communicatively connected" means connected by way of a connection, attachment or linkage between two or more relata which allows for reception and/or transmittance of information therebetween. For example, and without limitation, this connection may be wired or wireless, direct or indirect, and between two or more components, circuits, devices, systems, and the like, which allows for reception and/or transmittance of data and/or signal(s) therebetween. Data and/or signals therebetween may include, without limitation, electrical, electromagnetic, magnetic, video, audio, radio and microwave data and/or signals, combinations thereof, and the like, among others. A communicative connection may be achieved, for example and without limitation, through wired or wireless electronic, digital or analog, communication, either directly or by way of one or more intervening devices or components. Further, communicative connection may include electrically coupling or connecting at least an output of one device, component, or circuit to at least an input of another device, component, or circuit. For example, and without limitation, via a bus or other facility for intercommunication between elements of a computing device. Communicative connecting may also include indirect connections via, for example and without limitation, wireless connection, radio communication, low power wide area network, optical communication, magnetic, capacitive, or optical coupling, and the like. In some instances, the terminology "communicatively coupled" may be used in place of communicatively connected in this disclosure.

Further referring to FIG. 1, Computing device may include any computing device as described in this disclosure, including without limitation a microcontroller, microprocessor, digital signal processor (DSP) and/or system on a chip (SoC) as described in this disclosure. Computing device may include, be included in, and/or communicate with a mobile device such as a mobile telephone or smartphone. Computing device may include a single computing device operating independently, or may include two or more computing device operating in concert, in parallel, sequentially or the like; two or more computing devices may be included together in a single computing device or in two or more computing devices. Computing device may interface or communicate with one or more additional devices as described below in further detail via a network interface device. Network interface device may be utilized for connecting computing device to one or more of a variety of networks, and one or more devices. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network may employ a wired and/or a wireless mode of communication. In general, any network topology may be used. Information (e.g., data, software etc.) may be communicated to and/or from a computer and/or a computing device. Computing device may include but is not limited to, for example, a computing device or cluster of computing devices in a first location and a second computing device or cluster of computing devices in a second location. Computing device may include one or more computing devices dedicated to data storage, security, distribution of traffic for load balancing, and the like. Computing device may distribute one or more computing tasks as described below across a plurality of computing devices of computing device, which may operate in parallel, in series, redundantly, or in any other manner used for distribution of tasks or memory between computing devices. Computing device may be implemented, as a non-limiting example, using a "shared nothing" architecture.

With continued reference to FIG. 1, computing device may be designed and/or configured to perform any method, method step, or sequence of method steps in any embodiment described in this disclosure, in any order and with any degree of repetition. For instance, computing device may be configured to perform a single step or sequence repeatedly until a desired or commanded outcome is achieved; repetition of a step or a sequence of steps may be performed iteratively and/or recursively using outputs of previous repetitions as inputs to subsequent repetitions, aggregating inputs and/or outputs of repetitions to produce an aggregate result, reduction or decrement of one or more variables such as global variables, and/or division of a larger processing task into a set of iteratively addressed smaller processing tasks. Computing device may perform any step or sequence of steps as described in this disclosure in parallel, such as simultaneously and/or substantially simultaneously performing a step two or more times using two or more parallel threads, processor cores, or the like; division of tasks between parallel threads and/or processes may be performed according to any protocol suitable for division of tasks between iterations. Persons skilled in the art, upon reviewing the entirety of this disclosure, will be aware of various ways in which steps, sequences of steps, processing tasks, and/or data may be subdivided, shared, or otherwise dealt with using iteration, recursion, and/or parallel processing.

Figure 2:
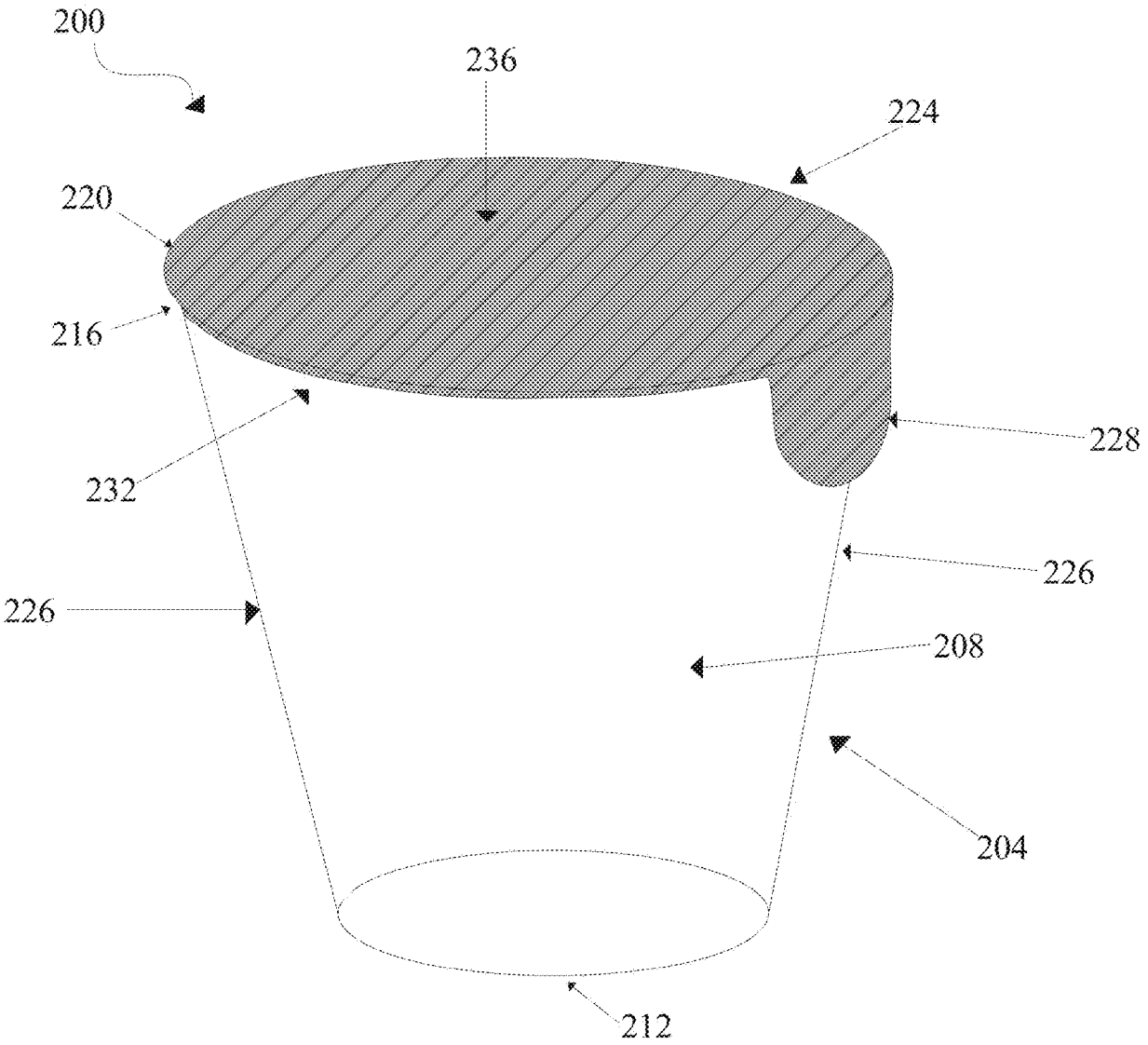
FIG. 2 illustrates a particular embodiment of a container with an edge-wrapping closure.

Now referring to FIG. 2, a nonlimiting particular embodiment of a container with an edge-wrapping enclosure 200 is shown. Container with an edge-wrapping enclosure 200 may be consistent with any methods or disclosure described with reference to FIG. 1. In this embodiment, the container body 204 may include a cavity 208 defined by a body wall extending between a closed end 212 and an open end 216. As used herein, "container body" refers to a vessel or receptacle configured to hold, store, or transport a substance, such as a liquid, solid, or semi-solid material. The container body may include a cavity for receiving the substance, an open end defined by a "rim", and a closed end opposite the open end. A "rim," for the purposes of this disclosure, is a peripheral edge portion of a container body at open end that provides a surface or contour for receiving a closure. The rim may, for example, include or be defined by a bead, flange, or other outwardly projecting structure. A "lid," for the purposes of this disclosure, is a cover or closure element configured to align with and seal against the rim of the container body. The lid may, for example, be formed from metal, polymer, paperboard, composite, or laminate materials, and may have dimensions and flexibility sufficient to fold over and engage the bead or other sealing features of the rim. The open end 216 is terminated by a rim having a bead 220 that projects outwardly from the body wall to form a lip. A lid 224 is disposed across the open end of the container body and is secured thereto by a fold-over sealing geometry in which a peripheral margin of the lid material is bent downward and around the bead of the rim, extending along at least a portion of the bead's outer surface. The lid in this embodiment may initially be placed flush across the opening of the container body such that the central portion of the lid forms a sealing interface with the top surface of the rim. The outer portion of the lid material projects radially outward beyond the rim and is folded downward to conform tightly to the bead. As a result, the closure comprises two distinct sealing regions: a primary horizontal seal across the opening of the container and a secondary vertical seal formed along the bead. These two sealing regions cooperate to enclose the bead between the lid material and the body wall, providing both hermetic sealing and mechanical reinforcement. In some embodiments, the lid comprises an interior surface 232 and an exterior surface 236. An "interior surface," for the purposes of this disclosure, is a side of a lid that faces toward and contacts the rim or rim bead of the container body when the lid is in place. In certain embodiments, interior surface may include a polymeric coating configured to promote sealing engagement by providing adhesion, flexibility, and barrier properties. The polymeric coating may comprise thermoplastic materials such as polyethylene, polypropylene, polyethylene terephthalate (PET), or multilayer laminates, and may be formulated to soften under heat or ultrasonic energy to facilitate bonding. An "exterior surface," for the purposes of this disclosure, is the side of the lid that faces away from the container body when the lid is secured. In certain embodiments, the exterior surface may include a printable surface configured to receive ink, embossing, or other indicia for labeling, branding, or regulatory information. In some embodiments, the printable surface may comprise a treated metallic foil, a polymeric film layer, or a coated paperboard, each adapted to maintain print quality while withstanding mechanical folding over the rim bead during sealing. The edge-wrapping closure shown in FIG. 2 structurally differs from conventional flat-sealed closures. In conventional systems, the lid lies across the rim in a single plane, relying solely on adhesive strength in that plane to prevent peeling. By contrast, the present embodiment employs the bead geometry as part of the sealing interface. The folded-over margin effectively locks around the bead, creating a hoop-like restraint that resists both upward displacement and lateral peeling forces. This increases overall seal integrity, particularly in applications where the container is subjected to internal pressure, thermal cycling, or mechanical stress. In some embodiments illustrated by FIG. 2, the folded portion of the lid 224 may extend partially or fully down the bead. A partial fold may secure only the upper half of the bead, whereas a full fold may extend beyond the bead to engage the sidewall 226 of the container body. Variations of this closure may therefore provide different sealing strengths and tactile properties. For instance, a full fold may produce a smoother, reinforced rim edge, which may reduce the risk of lid tearing during handling. The lid material used in this embodiment may be flexible and capable of conforming to the bead profile, such as laminated foils, polymeric films, or paper-based composites. In certain cases, the lid material may include co-extruded or laminated layers specifically designed to stretch and bend at the fold line without delamination. Adhesives or polymer coatings may be selectively applied to bond the lid both to the top sealing surface and to the bead's outer surface, creating a dual adhesion zone. Heat-activated adhesives may be employed to soften and flow around micro-irregularities of the bead surface, while pressure-sensitive adhesives may maintain a bond even under flexing or deformation. The embodiment shown in FIG. 2 may also include optional features such as pull tabs 228, perforations, or tear lines integrated into the folded edge. For example, a section of the folded-over lid may be left unsealed, providing a grip point for initiating removal. In another variation, perforations may be incorporated into the folded edge such that peeling back the lid causes the folded portion to separate in a controlled manner. These features provide user access while maintaining the structural and hermetic benefits of the edge-wrapping closure until intentional opening. In addition to sealing performance, the edge-wrapping closure shown in FIG. 2 provides aesthetic and functional benefits. The folded rim creates a continuous, smooth perimeter around the opening, which may improve container ergonomics and provide a tamper-evident appearance. The folded edge also increases the effective sealing surface area, enabling stronger adhesion without requiring excessive adhesive material. In some embodiments, the folded edge may be printed, embossed, or textured to highlight branding or to provide tactile feedback for locating the pull tab.

Figure 3A:
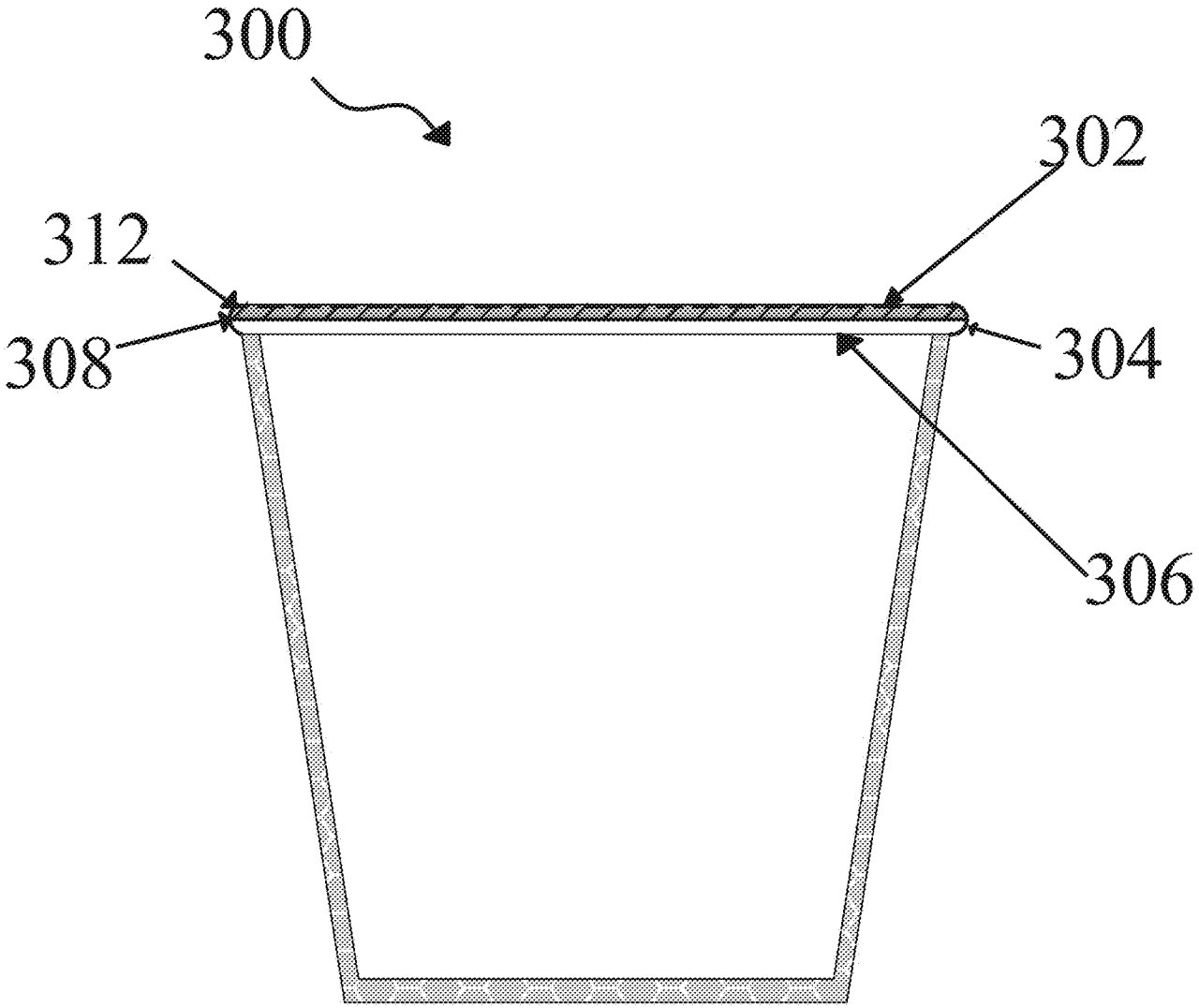
FIG. 3A-3B illustrates a particular embodiment of a container with an partial edge-wrapping geometry.

Now referring to FIG. 3A, a nonlimiting particular embodiment of a container with an partial edge-wrapping geometry 300 is shown. Container with an partial edge-wrapping geometry 300 may be consistent with any methods or disclosure described with reference to FIGS. 1 and 2. In some embodiments, the fold-over sealing geometry may be configured as a partial wrap in which the lid 302 margin only partially covers the rim bead 304 of the container body. In some embodiments, the rim 306 may be a generally flat or slightly angled flange extending outwardly from the body wall. A "Rim bead," for the purposes of this disclosure, is an outwardly projecting, rounded, thickened, or otherwise contoured feature that extends from or is formed along the rim. In certain embodiments, the rim bead may be formed integrally with the body wall by molding, rolling, or stamping. The rim bead may further serve to reinforce the open end of the container body and to provide a contoured surface against which a lid may be folded, crimped, or otherwise sealed. While the rim 306 may define the edge of the cavity itself, the rim bead provides a sealing feature that enhances structural strength and mechanical engagement with the lid. In this configuration, the central portion of the lid is sealed flush across the open end of the container body, while the peripheral margin of the lid 302 extends outwardly and is folded downward to cover only a portion of the bead, for example to the midpoint of the bead height. The lower portion of the bead may remain exposed, thereby reducing the extent of material coverage along the outer surface of the container body. The partial wrap configuration may be advantageous where a balance is desired between seal integrity, ease of manufacture, and peelability. Because the lid is folded only to the midpoint 308 of the bead, less force may be required to fold and secure the lid 302 margin compared to a full wrap configuration. This may allow the use of stiffer or thicker lid materials that might otherwise be prone to cracking or tearing when bent fully around the bead. Additionally, the partial wrap may reduce stress concentrations at the fold line, prolonging the durability of laminated or multi-layer lid materials. A "fold line," for the purposes of this disclosure, is the region of transition where the lid material bends or wraps over the rim or rim bead of the container body during sealing. The fold line 312 may correspond to a localized area of curvature in the lid material, which may be defined by mechanical pressure, heat, ultrasonic energy, or adhesive bonding during the sealing process. In some embodiments, the fold line functions as a hinge-like zone where stresses from folding, handling, or internal pressure are concentrated, and design features such as partial wraps or reinforcement layers may be employed to distribute such stresses and improve seal integrity. In some embodiments, adhesives or polymer coatings may be selectively applied to secure the lid along both the top sealing surface of the rim and the covered portion of the bead. The adhesive distribution may be concentrated at the upper region of the bead to ensure that the partial fold bonds tightly, while leaving the lower bead surface uncoated. This arrangement provides dual-plane sealing (horizontal and vertical) while requiring less adhesive material than a full wrap, thereby improving material efficiency. Structurally, the partial wrap configuration still benefits from increased resistance to peeling relative to flat-sealed lids, since the folded portion engages at least part of the bead's vertical surface and resists outward shear forces. However, because the fold does not extend the full height of the bead, the closure may be more easily opened by a user, particularly where the fold terminates at a region that allows for the insertion of a fingernail or the initiation of a pull tab. In some embodiments, the edge of the folded portion may be configured with a slight flare or unbonded segment to serve as an intentional lift point. The partial wrap embodiment may also be beneficial for certain container designs where the bead is relatively large or thick, as folding the lid margin only to the midpoint may avoid material bunching or creasing at the lower edge. In some embodiments, the bead may be specifically dimensioned to accommodate a partial wrap, with a flat or gently sloped upper region optimized for adhesive bonding and a lower region left exposed. The exposed portion of the bead may further serve an ergonomic function, providing a tactile distinction between sealed and unsealed regions to aid in locating the lid edge. In certain variations, the partial wrap may be combined with additional features such as embossing, texturing, or perforations in the folded portion. For example, the partially wrapped section may be embossed during sealing to improve adhesion or may include decorative branding. Alternatively, perforations may extend through the folded margin at the midpoint of the bead, providing a controlled tear path for user opening.

Figure 3B:
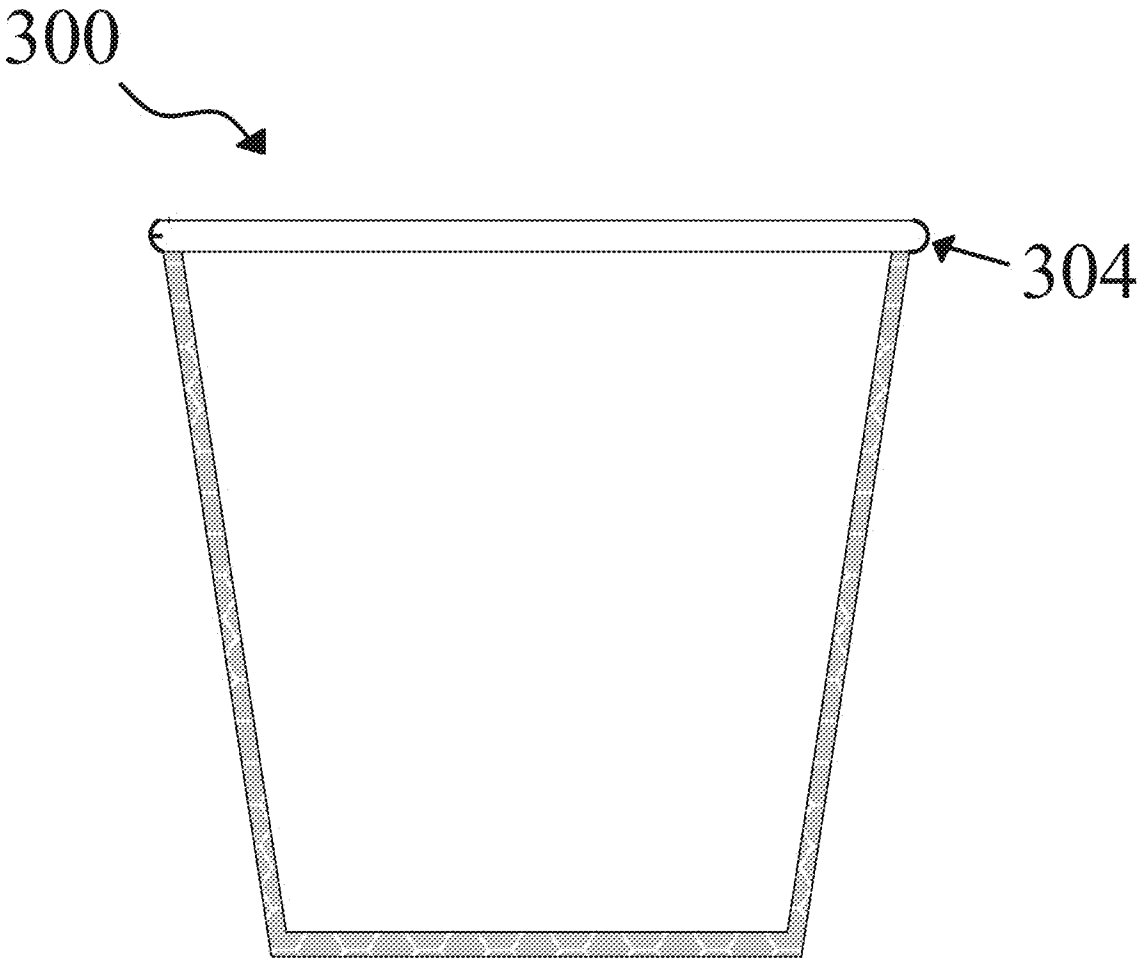

Now referring to FIG. 3B, a nonlimiting particular embodiment of a container with an partial edge-wrapping geometry 300 is shown. Rim bead 304 may comprise an outwardly projecting feature formed integrally with the rim of the container body. In various embodiments, the rim bead may be rounded, thickened, or otherwise contoured to provide reinforcement to the rim, improve sealing engagement with a lid, and facilitate handling or automated processing during filling and closure operations. The rim bead may extend continuously around the perimeter of the rim or may be segmented into localized portions depending on manufacturing requirements.

Figure 4:
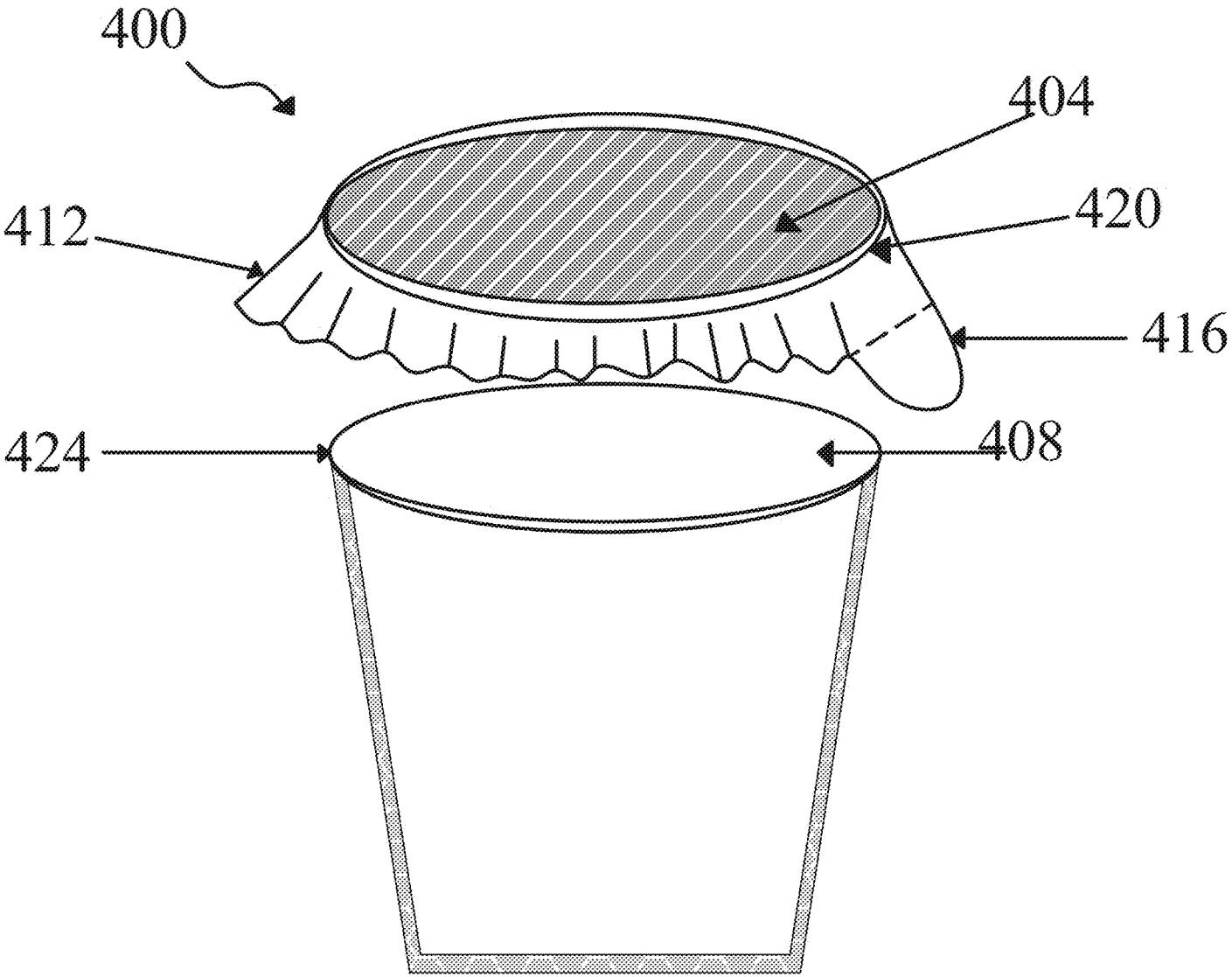
FIG. 4 illustrates a particular embodiment of a container with a dual-layer lid

Now referring to FIG. 4, a nonlimiting particular embodiment of a container with a dual-layer lid 400 structure is shown. In some embodiments, the container may include a dual-layer lid structure configured to enhance both sealing integrity and barrier performance. In some embodiments, the lid comprises a multi-layer structure comprising a metallic barrier layer disposed flat across the opening, wherein the lid further comprises a polymeric support layer folded around the bead. Container with a dual-layer lid 400 may be consistent with any methods or disclosure described with reference to FIGS. 1, 2, and 3. In this embodiment, the lid includes at least two distinct layers of material, each performing a specialized function during sealing. A first layer 404, such as a metallic foil barrier (e.g., aluminum), may be disposed across the opening 408 of the container body. This first layer remains substantially flat across the rim 424 and provides a primary hermetic seal over the open end. The metallic foil layer may function as a gas and moisture barrier, preserving the freshness of the contents within the cavity of the container body. A second layer 412, such as a polymer support layer, may be laminated to the foil layer or otherwise affixed thereto. This polymer support layer extends radially outward beyond the rim bead and is folded downward during sealing to conform around at least a portion of the bead. In this configuration, the foil layer provides sealing across the opening, while the polymer support layer provides additional mechanical retention by gripping the bead. The polymer support layer may also enhance flexibility at the fold line, reducing the risk of cracking or tearing in the metallic foil. The dual-layer configuration may offer several advantages. First, it allows the barrier layer to remain undisturbed across the container opening, maintaining its structural integrity and barrier properties. Second, it allows the fold-over portion to be carried primarily by the polymer support layer, which is engineered for flexibility and adhesion. Third, the configuration increases overall seal strength by combining horizontal hermetic sealing with vertical bead engagement, while minimizing material stress in the foil layer. In some embodiments, adhesives may be selectively applied to bond the foil to the top surface of the rim and to bond the polymer support layer to the bead. Heat sealing, ultrasonic welding, or pressure bonding may be used depending on the material composition. The polymer support layer may further include pre-creased or thinned fold lines to facilitate uniform bending around the bead. Variations of this embodiment may include additional layers, such as printable paper laminates for branding, or adhesive tie layers between the foil and polymer to optimize bonding. In some embodiments, the dual-layer lid may incorporate tamper-evident features, such as perforations in the polymer layer that break upon peeling while leaving the foil intact, or vice versa. Accordingly, the dual-layer lid with fold provides a synergistic design in which one layer ensures hermetic sealing across the opening and another layer provides mechanical locking around the bead, thereby combining the functional strengths of both materials while reducing their individual weaknesses. Accordingly, the partial wrap configuration enables a container closure that improves sealing performance compared to flat-sealed lids, while reducing the folding complexity, adhesive usage, and opening force associated with full wrap designs. This embodiment offers a practical balance of hermetic sealing, manufacturability, and consumer usability. In some embodiments, the dual-layer lid 400 may include a folded lid with an integrated pull tab. In this configuration, the lid is sealed across the open end of the container body and folded downward around the bead of the rim 424. Unlike conventional pull tabs that are separately attached or laminated, the pull tab in this embodiment is formed directly from the folded margin 420 of the lid. The pull tab may be created by leaving a designated section of the folded margin unsealed against the bead during the folding process. This unsealed region may extend downward beyond the bead to form a flap that a user can grasp. Alternatively, the lid margin may be extended beyond the bead in a specific region, creating a downward-projecting tab integral with the folded portion. This approach integrates functionality into the closure geometry, eliminating the need for secondary pull-tab attachments and simplifying manufacturing. In some embodiments, the integrated pull tab may include reinforcement features to improve durability during opening. For example, the tab may include additional lamination layers, thicker polymer reinforcement, or embedded threads of paper, foil, or plastic. Such reinforcement prevents tearing or delamination when force is applied to initiate peeling. The integrated pull tab 416 may also include perforations or frangible lines adjacent to the unsealed region, enabling the lid to separate cleanly from the bead when the tab is lifted. The integrated pull tab design offers multiple advantages. It provides a reliable grip point without requiring additional material or manufacturing steps, enhances tamper evidence (since the folded seal must be broken along both planes before access is gained), and maintains the aesthetic continuity of the bead-wrapping closure. In some embodiments, the pull tab may be recessed against the container wall, preventing accidental snagging, while in other embodiments it may be textured, embossed, or printed with indicia instructing the user on how to open the container. Accordingly, the folded lid with integrated pull tab 416 combines sealing strength from the fold-over bead geometry with functional ease of access, resulting in a closure that is both robust and user-friendly. The pull tab configured may be implemented, without limitation, as disclosed in U.S. application Ser. No. 18/606,085, filed Mar. 15, 2024 and entitled "METHOD OF MANUFACTURE FOR A HIGHLY PEELABLE LID WITH A FRANGIBLE SEAL" the entirety of which is incorporated herein by reference.

Figure 5:
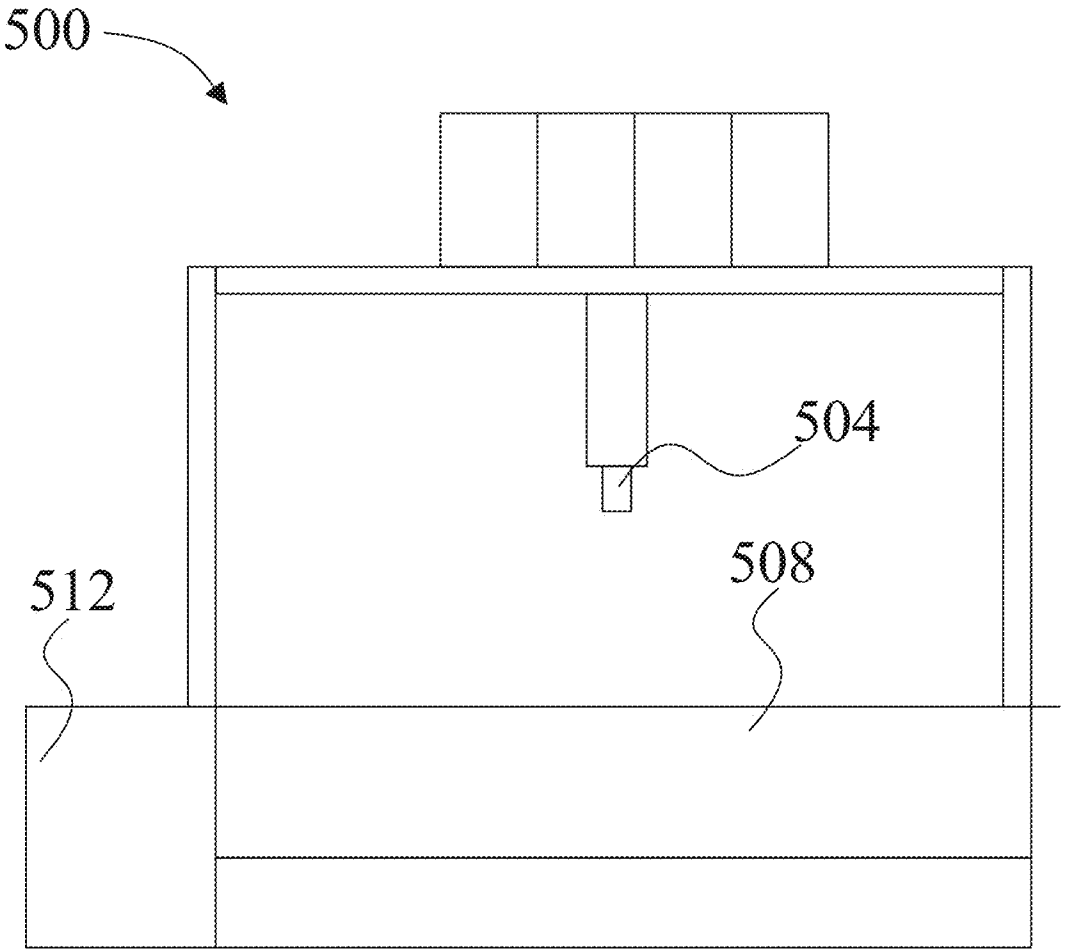
FIG. 5 is a block diagram illustrating a particular embodiment of a manufacturing device.

Further referring to FIG. 5, manufacturing device 500 may include an automated manufacturing system. In some embodiments, an automated manufacturing system is a manufacturing device 500 including a controller 512 that controls one or more manufacturing steps automatically. Controller 512 may include a sequential control device that produces a sequence of commands without feedback from other components of automated manufacturing system. Controller 512 may include a feedback control device that produces commands triggered or modified by feedback from other components. Controller 512 may perform both sequential and feedback control. In some embodiments, controller 512 includes a mechanical device. In other embodiments, controller 512 includes an electronic device. Electronic device may include digital or analog electronic components, including without limitation one or more logic circuits, such one or more logic gates, programmable elements such as field-programmable arrays, multiplexors, one or more operational amplifiers, one or more diodes, one or more transistors, one or more comparators, and one or more integrators. Electronic device may include a processor. Electronic device may include a computing device 500 as described below in reference to FIG. 5. Computing device 500 may include a computing device 500 embedded in manufacturing device 500; as a non-limiting example, computing device 500 may include a controller 512, which may be housed in a unit that combines the other components of manufacturing device 500. Controller 512 may include a manufacturer client of plurality of manufacturer clients; controller 512 may be communicatively coupled to a manufacturer client of plurality of manufacturer clients.

Continue referring to FIG. 5, controller 512 may include a component embedded in manufacturing device 500; as a non-limiting example, controller 512 may include a microcontroller 508, which may be housed in a unit that combines the other components of manufacturing device 500. Further continuing the example, microcontroller 508 may have program memory, which may enable controller 512 to load a program that directs manufacturing device 500 to perform an automated manufacturing process. Similarly, controller 512 may include any other components of a computing device 500 as described below in reference to FIG. 5 in a device housed within manufacturing device 500. In other embodiments, controller 512 includes a computing device 500 that is separate from the rest of the components of manufacturing device 500; for instance, controller 512 may include a personal computer, laptop, or workstation connected to the remainder of additive manufacturing device 500 by a wired or wireless data connection. In some embodiments, controller 512 includes both a personal computing device 500 where a user may enter instructions to generate a program for turning workpiece into a finished product, and an embedded device that receives the program from the personal computing device 500 and executes the program. Persons skilled in the art will be aware of various ways that a controller 512, which may include one or more computing device, may be connected to, or incorporated in an automated manufacturing system as described above.

Still referring to FIG. 5, controller 512 may control components of automated manufacturing system; for instance, controller 512 may control elements including without limitation tool changer to switch endmills, spindle or gear systems operatively coupled to spindle to regulate spindle rotational speed, linear movement of applicator 504, base table, or both, and rotation or rotational position of rotary table. As an example, applicator 504 may be moved about using computerized numerical control (CNC) devices and/or motion controls that are automated and operate by precisely programmed commands that control movement of one or more parts of the equipment to affect the material removal. CNC machines, their operation, programming, and relation to computer aided manufacturing (CAM) tools and computer aided design (CAD) tools are well known and need not be described in detail herein for those skilled in the art to understand the scope of the present invention and how to practice it in any of its widely varying forms. Similarly, controller 512 may coordinate deposition and/or curing of material in additive manufacturing processes, where manufacturing device 500 is an additive manufacturing device. Persons skilled in the art, upon reading the entirety of this disclosure, will be aware of similar automated control systems usable for various forms manufacturing. Controller may be, be included in, include, and/or be in communication with computing device 500.

Further referencing on FIG. 5, in operation, the manufacturing device 500 may deposit layers of edible material or ingredient, including without limitation powdered supplements and/or substrates, as programmed by computing device 500 and/or controller 512.

It is to be noted that any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., CD, CD-R, DVD, DVD-R, etc.), a magneto-optical disk, a read-only memory "ROM" device, a random access memory "RAM" device, a magnetic card, an optical card, a solid-state memory device, an EPROM, an EEPROM, and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instruction, or portion thereof, for execution by a machine (e.g., a computing device) and any related information (e.g., data structures and data) that causes the machine to perform any one of the methodologies and/or embodiments described herein.

Examples of a computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In one example, a computing device may include and/or be included in a kiosk.

Figure 6:
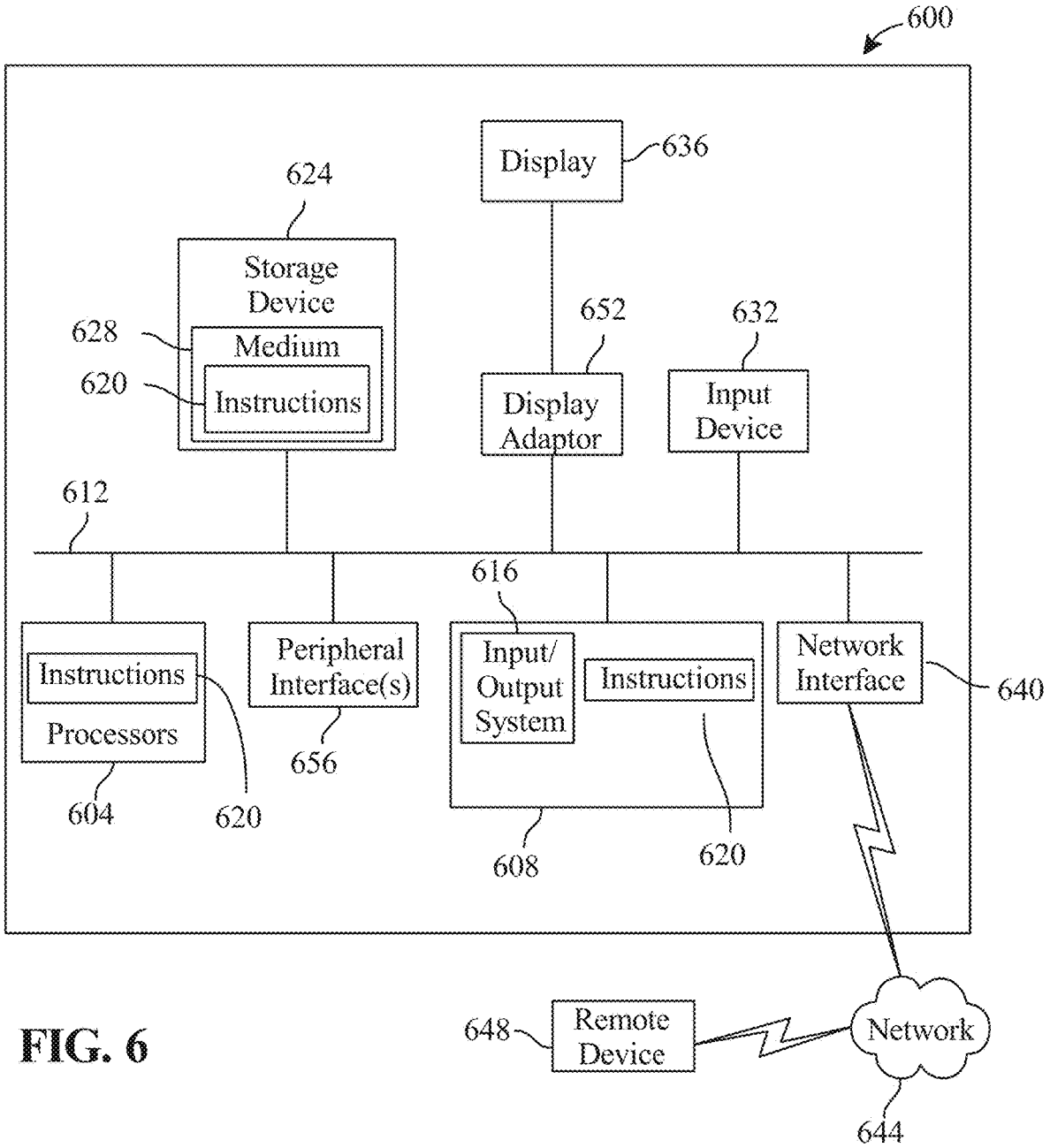
FIG. 6 is a block diagram of a computing system that can be used to implement any one or more of the methodologies disclosed herein and any one or more portions thereof.

FIG. 6 shows a diagrammatic representation of one embodiment of a computing device in the exemplary form of a computer system 600 within which a set of instructions for causing a control system to perform any one or more of the aspects and/or methodologies of the present disclosure may be executed. It is also contemplated that multiple computing devices may be utilized to implement a specially configured set of instructions for causing one or more of the devices to perform any one or more of the aspects and/or methodologies of the present disclosure. Computer system 600 includes a processor 604 and a memory 608 that communicate with each other, and with other components, via a bus 612. Bus 612 may include any of several types of bus structures including, but not limited to, a memory bus, a memory controller, a peripheral bus, a local bus, and any combinations thereof, using any of a variety of bus architectures.

Processor 604 may include any suitable processor, such as without limitation a processor incorporating logical circuitry for performing arithmetic and logical operations, such as an arithmetic and logic unit (ALU), which may be regulated with a state machine and directed by operational inputs from memory and/or sensors; processor 604 may be organized according to Von Neumann and/or Harvard architecture as a non-limiting example. Processor 604 may include, incorporate, and/or be incorporated in, without limitation, a microcontroller, microprocessor, digital signal processor (DSP), Field Programmable Gate Array (FPGA), Complex Programmable Logic Device (CPLD), Graphical Processing Unit (GPU), general purpose GPU, Tensor Processing Unit (TPU), analog or mixed signal processor, Trusted Platform Module (TPM), a floating point unit (FPU), system on module (SOM), and/or system on a chip (SoC). Each processor and/or processor core may perform a state transition, instruction, and/or instruction step during a period of a "clock," or a regular oscillator that generates periodic output waveform, such as a square wave, having a regular period; different processors and/or cores may have distinct clocks. A processor may operate as and/or include a processing unit that performs instruction inputs, arithmetic operations, logical operations, memory retrieval operations, memory allocation operations, and/or input and output operations; a control circuit or module within a processor may determine which of the above-described functions a processor and/or unit within a processor will perform on a given clock cycle. A processor may include a plurality of processing units or "cores," each of which performs the above-described actions; multiple cores may work on disparate instruction sets and/or may work in parallel. A single core may also include multiple arithmetic, logic, or other units that can work in parallel with each other. Parallel computing between and/or within processors and/or cores may include multithreading processes and/or protocols such as without limitation Tomasulo's algorithm. As used in this disclosure, "a processor," and/or "configuring a processor," is equivalent for the purposes of this disclosure to at least a processor, a plurality of processors, and/or a plurality of processor cores, and/or programming at least a processor, a plurality of processors, and/or a plurality of processor cores, which may be configured to operate on instructions in parallel and/or sequentially according to multithreading algorithms, parallel computing, load and/or task balancing, and/or virtualization, for instance and without limitation as described below.

Memory 608 may include various components (e.g., machine-readable media) including, but not limited to, a random-access memory component, a read only component, and any combinations thereof. In one example, a basic input/output system 616 (BIOS), including basic routines that help to transfer information between elements within computer system 600, such as during start-up, may be stored in memory 608. Memory 608 may also include (e.g., stored on one or more machine-readable media) instructions (e.g., software) 620 embodying any one or more of the aspects and/or methodologies of the present disclosure. In another example, memory 608 may further include any number of program modules including, but not limited to, an operating system, one or more application programs, other program modules, program data, and any combinations thereof. Memory 608 may include a primary memory and a secondary memory. "Primary memory," which may be implemented, without limitation as "random access memory" (RAM), is memory used for temporarily storing data for active use by a processor. In one or more embodiments, during use of the computing device, instructions and/or information may be transmitted to primary memory wherein information may be processed. In one or more embodiments, information may only be populated within primary memory while a particular software is running. In one or more embodiments, information within primary memory is wiped and/or removed after the computing device has been turned off and/or use of a software has been terminated. In one or more embodiments, primary memory may be referred to as "Volatile memory" wherein the volatile memory only holds information while data is being used and/or processed. In one or more embodiments, volatile memory may lose information after a loss of power.

Computer system 600 may also include a storage device 624. Examples of a storage device (e.g., storage device 624) include, but are not limited to, a hard disk drive, a magnetic disk drive, an optical disc drive in combination with an optical medium, a solid-state memory device, and any combinations thereof. Storage device 624 may be connected to bus 612 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In one example, storage device 624 (or one or more components thereof) may be removably interfaced with computer system 600 (e.g., via an external port connector (not shown)). Particularly, storage device 624 and an associated machine-readable medium 628 may provide nonvolatile and/or volatile storage of machine-readable instructions, data structures, program modules, and/or other data for computer system 600. In some embodiments, storage device 624 and/or devices "Secondary memory" also known as "storage," "hard disk drive" and the like for the purposes of this disclosure is a long-term storage device in which an operating system and other information is stored; operating system and/or main program instructions may alternatively or additionally be stored in hard-coded memory ROM, or the like. In one or remote embodiments, information may be retrieved from secondary memory and copied to primary memory during use. In one or more embodiments, secondary memory may be referred to as non-volatile memory wherein information is preserved even during a loss of power. In some embodiments, data from secondary memory is transferred to primary memory before being accessed by a processor. In one or more embodiments, data is transferred from secondary to primary memory wherein circuitry may access the information from primary memory. In one example, software 620 may reside, completely or partially, within machine-readable medium 628. In another example, software 620 may reside, completely or partially, within processor 604.

Computer system 600 may also include an input device 632. In one example, a user of computer system 600 may enter commands and/or other information into computer system 600 via input device 632. Examples of an input device 632 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. Input device 632 may be interfaced to bus 612 via any of a variety of interfaces (not shown) including, but not limited to, a serial interface, a parallel interface, a game port, a USB interface, a FIREWIRE interface, a direct interface to bus 612, and any combinations thereof. Input device 632 may include a touch screen interface that may be a part of or separate from display 636, discussed further below. Input device 632 may be utilized as a user selection device for selecting one or more graphical representations in a graphical interface as described above.

A user may also input commands and/or other information to computer system 600 via storage device 624 (e.g., a removable disk drive, a flash drive, etc.) and/or network interface device 640. A network interface device, such as network interface device 640, may be utilized for connecting computer system 600 to one or more of a variety of networks, such as network 644, and one or more remote devices 648 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 644, may employ a wired and/or a wireless mode of communication. In general, any network topology may be used. Information (e.g., data, software 620, etc.) may be communicated to and/or from computer system 600 via network interface device 640.

Computer system 600 may further include a video display adapter 652 for communicating a displayable image to a display device, such as display 636. Examples of a display device include, but are not limited to, a liquid crystal display (LCD), a cathode ray tube (CRT), a plasma display, a light emitting diode (LED) display, and any combinations thereof. Display adapter 652 and display 636 may be utilized in combination with processor 604 to provide graphical representations of aspects of the present disclosure. In addition to a display device, computer system 600 may include one or more other peripheral output devices including, but not limited to, an audio speaker, a printer, and any combinations thereof. Such peripheral output devices may be connected to bus 612 via a peripheral interface 656. Examples of a peripheral interface include, but are not limited to, a serial port, a USB connection, a FIREWIRE connection, a parallel connection, and any combinations thereof.

Further referring to FIG. 6, a computing device may include any computing device as described in this disclosure, including without limitation a microcontroller, microprocessor, digital signal processor (DSP) and/or system on a chip (SoC) as described in this disclosure. A computing device may include, be included in, and/or communicate with a mobile device such as a mobile telephone or smartphone. A computing device may include a single device having components as described above operating independently, or may include two or more such devices and/or components thereof operating in concert, in parallel, sequentially or the like; two or more devices, processors, memory elements, and the like may be included together in a single computing device or in two or more computing devices. A computing device may interface or communicate with one or more additional devices as described below in further detail via a network interface device.

In some embodiments, and still referring to FIG. 6, a computing device may be a component of a combination of at least a computing device; at least a computing device may include, as a non-limiting example, a first computing device or cluster of computing devices in a first location and a second computing device or cluster of computing devices in a second location. At least a computing device may include one or more computing devices dedicated to data storage, security, distribution of traffic for load balancing, and the like. At least a computing device may distribute one or more computing tasks as described below across a plurality of computing devices of computing device, which may operate in parallel, in series, redundantly, or in any other manner used for distribution of tasks or memory between computing devices. At least a computing device may be implemented, as a non-limiting example, using a "shared nothing" architecture.

With continued reference to FIG. 6, one or more programs or software instructions may include a principal program and/or operating system; principal program and/or operating system may be a program that runs automatically upon startup of a computing device and manages computer hardware and software resources. Principal program and/or operating system may include "startup," "loop," and/or "main" programs on a microcontroller; such programs may initialize hardware resources and subsequently iterate through a series of instructions to make function calls, read in data at input ports, output data at output ports, and process interrupts caused by asynchronous data inputs or the like. Principal program and/or operating system may include, without limitation, an operating system, which may schedule program tasks to be implemented by one or more processors, act as an intermediary between one or more programs and inputs, outputs, hardware and/or memory. Examples of operating systems include without limitation Unix, Linux, Microsoft Windows, Android, Disc Operating System (DOS) and the like. Operating systems may include, without limitation, multi-computer operating systems that run across multiple computing devices, real-time operating systems, and hypervisors. A "hypervisor," as used in this disclosure, is an operating system that runs a virtual machine and/or container, where virtual machines and/or containers create virtual interfaces for programs that mimic the behavior of hardware elements such as processors and/or memory; interactions with such virtual interfaces appear, to programs executed on virtual machines, to function as interactions with physical hardware, while in reality the hypervisor and/or programs such as containers (1) receive inputs from programs to the virtual resources and allocate such inputs to physical hardware that is not directly accessible to the programs, and (2) receive outputs from physical hardware and transmit such outputs to the programs in the form of apparent outputs from the virtual hardware. In some cases, one or more of computing system 600, processor 604, and memory 608 may be virtualized; that is, a virtual machine and/or container may interact directly with such computing system 600, processor 604, and/or memory 608, while managing communications therefrom and thereto via a virtual interface with programs. Computer virtualization may include dividing, or augmenting computing resources into a virtual machine, operating system, processor, and/or container. Virtualization of computer resources may be implemented through use of (1) multiple components, or portions thereof, working in concert, as if they were one unified (virtual) component; and/or (2) a portion of one or more components working as though it were a complete (virtual) component. For instance, where processor 604 comprises a plurality of processors and/or processor cores, virtualization may, in some cases, simulate or emulate a single (virtual) processor whose functions are allocated to one or more of the plurality of processors and/or processor cores. In this case, while processor 604 may be said to be virtualized, the processor 604, nevertheless, comprises actual hardware processor(s) or portion(s) thereof. Accordingly, in this disclosure, where a processor is said to perform instructions, such processor may comprise a virtualized processor, comprising a plurality or portion of hardware processors. Likewise, in this disclosure, where a memory is said to contain (i.e., store) instructions, such memory may comprise a virtualized memory, comprising a plurality or portion of memories. Technologies that enable such virtualization include (1) QEMU, www.qemu.org; (2) VMware by Broadcom Inc of Palo Alto, California; (3) VirtualBox by Oracle Corporation headquartered in Austin, Texas; and (4) kernel-based virtual machine (KVM) www.linux-kvm.org.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and software according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A method for sealing a container using an edge-wrapping closure, wherein the method further comprises:

providing a container body comprising:

an open end having a rim defined by a bead extending outwardly from a body wall, wherein the body wall comprises one or more detents configured to engage a sealed lid;

a cavity; and a closed end;

receiving a lid;

aligning and placing the lid flush against the rim of the open end of the container body; and sealing the lid over the rim of the open end of the container body by folding the lid over and around the bead of the rim wherein the lid extends along an outer surface of the bead, wherein the bead of the rim comprises a polymeric coating.

2. The method of claim 1, wherein the bead is fully enclosed by lid material when the lid is sealed over the rim, wherein a folded portion of the lid extends past the bead and contacts a sidewall of the container body.

3. The method of claim 1, wherein the lid partially covers the bead up to at least a midpoint of a height of the bead.

4. The method of claim 1, wherein the lid comprises a multi-layer structure comprising a metallic barrier layer disposed flat across the open end, and wherein the lid further comprises polymeric support layer folded around the bead.

5. The method of claim 1, wherein sealing the lid over the rim of the open end of the container body further comprises applying heat at a fold line, wherein applying heat at the fold line conforms the lid to the body wall of the container body.

6. The method of claim 5, wherein aligning and placing the lid further comprises pre-creasing the fold line to align with the bead during sealing.

7. The method of claim 5, wherein the lid comprises an adhesive layer positioned along the fold line.

8. The method of claim 5, wherein applying the heat at the fold line comprises applying the heat using one or more of: convection heat sealing, induction sealing, and ultrasonic welding.

9. The method of claim 1, wherein sealing the lid further comprises applying pressure using one or more of a: forming tool, roller, and crimping die.

10. The method of claim 1, wherein the lid further comprises a pull tab formed by leaving a section of a folded margin unsealed against the bead.

11. The method of claim 10, wherein the pull tab is recessed against a wall of the container body when the lid is sealed over the rim of the open end of the container body.

12. The method of claim 1, wherein the lid comprises an adhesive layer positioned along a fold line.

13. The method of claim 1, wherein the method further comprises de-nesting one or more lids.

14. The method of claim 1, wherein the lid comprises an aluminum foil material and polymeric coatings.

15. The method of claim 1, wherein the lid comprises:

an interior surface having a polymeric coating; and an exterior surface having a printable surface.

16. The method of claim 1, wherein the container body comprises a recycled material.

17. A container body with an edge-wrapping closure comprising:

a container body comprising:

an open end having a rim defined by a bead extending outwardly from a body wall, wherein the body wall comprises one or more detents configured to engage a sealed lid;

a cavity; and a closed end; and a lid aligned and placed flush against the rim of the open end of the container body, wherein the lid is folded over and around the bead of the rim wherein the lid extends along an outer surface of the bead, wherein the bead of the rim comprises a polymeric coating.

18. The container body of claim 17, wherein the container body further comprises a pull-tab.

19. The container body of claim 17, wherein the lid partially covers the bead up to at least a midpoint of a height of the bead.

20. The container body of claim 17, wherein the lid comprises an adhesive layer positioned along a fold line.

* * * * *